United States Patent [19]

Voris

[11] Patent Number: 4,765,613

[45] Date of Patent: Aug. 23, 1988

[54] PROGRESSIVE RESISTANCE EXERCISE DEVICE

[75] Inventor: Harv Voris, North Hollywood, Calif.

[73] Assignee: Paramount Fitness Equipment Corporation, Los Angeles, Calif.

[21] Appl. No.: 6,049

[22] Filed: Jan. 22, 1987

[51] Int. Cl.[4] ..... A63B 21/24

[52] U.S. Cl. ..... 272/129; 272/134; 272/DIG. 5; 272/DIG. 6

[58] Field of Search ..... 73/379, 380, 381; 272/134, 129, 130, 131, DIG. 6, DIG. 5

[56] References Cited

U.S. PATENT DOCUMENTS 3,395,698 8/1968 Morehouse ..... 272/129 X
3,767,195 10/1973 Dimick ..... 73/379 X
3,869,121 3/1975 Flavell .
4,235,437 11/1980 Ruis et al. .
4,261,562 4/1981 Flavell .
4,354,676 10/1982 Ariel .
4,518,163 5/1985 Bruder .
4,544,154 10/1985 Ariel ..... 73/379 X
4,569,518 2/1986 Fulks ..... 272/129
4,620,703 11/1986 Greenhut ..... 272/131 X

*Primary Examiner*—Richard J. Apley
*Assistant Examiner*—David J. Bender
*Attorney, Agent, or Firm*—Nilsson, Robbins, Dalgarn, Berliner, Carson & Wurst

[57] ABSTRACT

A resistance mechanism for exercise devices which progressively varies resistance applied to a lifting mechanism in only positive resistance directions, while reducing the resistance to substantially zero if the lifting mechanism is moved in a negative resistance direction.

17 Claims, 4 Drawing Sheets

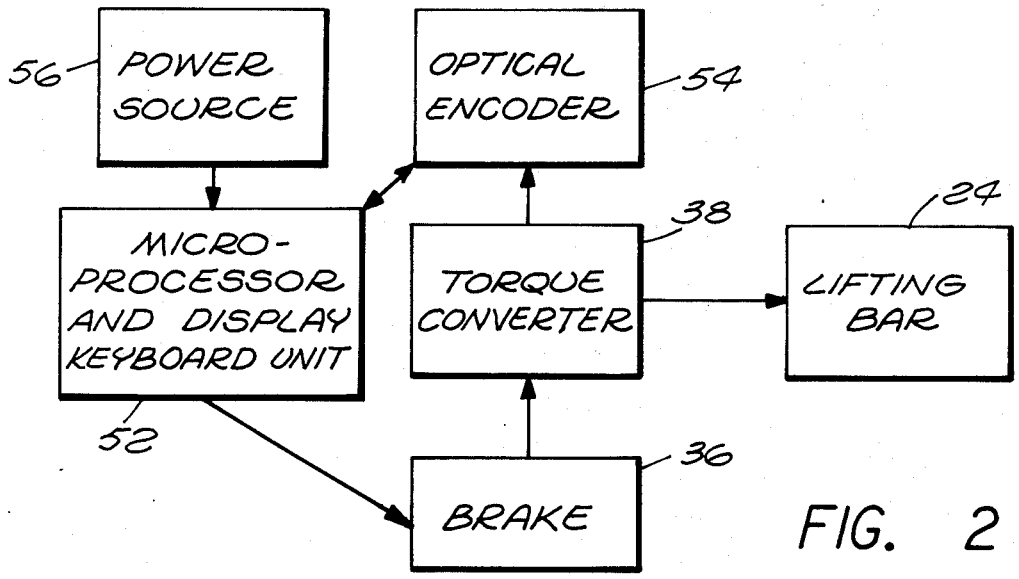
FIG. 2
FIG. 3
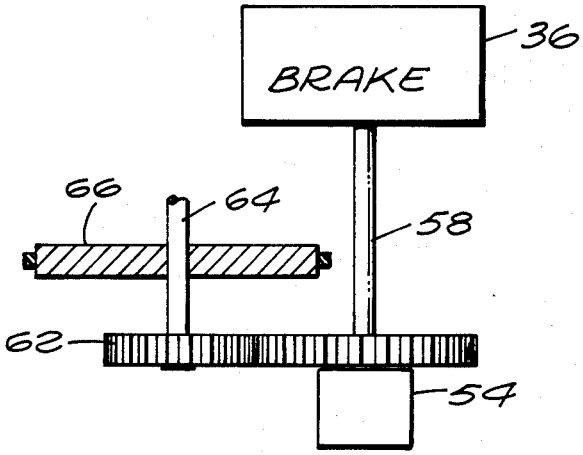
FIG. 4
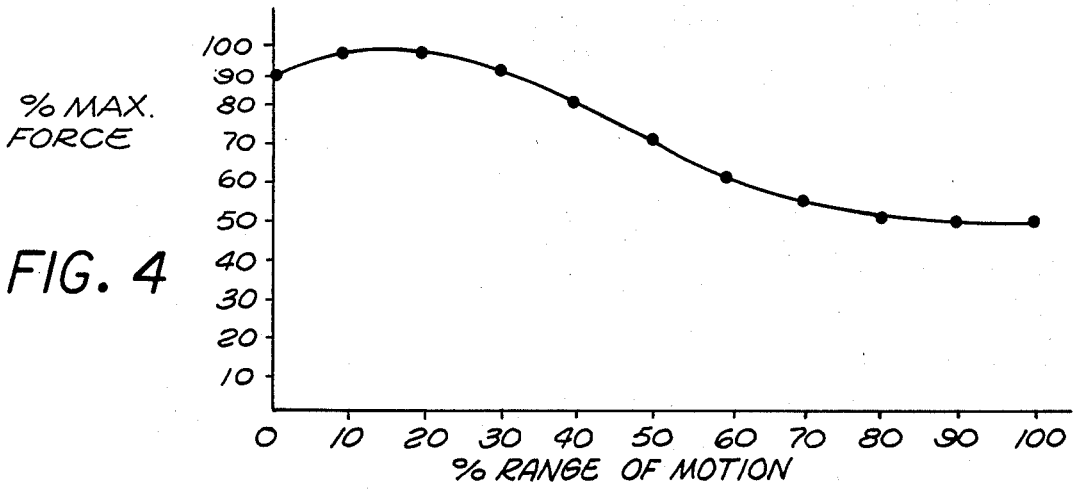

PROGRESSIVE RESISTANCE EXERCISE DEVICE

BACKGROUND OF THE INVENTION

The present invention is directed to an exercise device, specifically a progressive resistance exercise device.

One particular way to increase muscular strength is to provide a resistance to muscular movement during the course of an exercise. This type of strength training is generally referred to as resistance training and usually involves the repetitive raising or lowering of a load.

In the past, resistance training utilized free weights, such as barbells and dumbbells, which were handled by the exerciser during repetitive movements of a particular muscle or muscle group. While training with free weights provides an exerciser with the necessary resistance to muscular movement and thus provides the results sought by resistance training, there are many drawbacks in the use of free weights.

One disadvantage in using free weights is the inability to progressively increase or decrease the weight resistance during the course of an exercise. In general, the application of a progressively varying resistance during the course of a particular exercise, either in a response to the effort being applied by the exerciser or in response to a predetermined format for a particular exercise, has been found to beneficially improve muscle strength in comparison to traditional free weight training which does not provide such progressive resistance.

Another drawback with free weight training is the need to have another individual act as a spotter during the performance of an exercise, since the only support for the free weights is that support provided by the exerciser holding the weights. If the exerciser becomes tired or loses his grip of the free weights, the weights could fall onto the exerciser and result in serious injury.

Various types of machines have been devised which alleviate the need for spotters by supporting the weights independent of the exerciser. Some of these machines also provide a progressively varying resistance to the muscular movement during the course of an exercise.

One particular type of exercise device which independently supports numerous weights for use during an exercise is generally referred to as a weight-pulley machine. These weight pulley machines allow an exerciser to lift one or more numerous weights along a support post to which the weights are mounted. While these machines alleviate the danger of a falling weight, the exerciser can still be harmed as a result of the bar or lever to which the weights are coupled, typically by one or more cables, dropping back down on the exerciser.

Other types of devices completely dispense with the use of individual weights by utilizing instead, for example, an electrical motor or generator, or a hydraulically operated system to apply resistance to the movement of a bar or other suitable lifting mechanism. With these types of devices, the exerciser will exert a force, for example, upon a bar to move the bar along a predefined route or path, while a resistance is exerted to such pull by the operation of the electrical motor or generator. Examples of devices which utilize an electrical generator as the resistance applying mechanism are disclosed in U.S. Pat. Nos. 4,261,562 and 3,869,121.

Generally, with these types of devices a cable is wound about the rotatable axle of the electrical generator or motor. The individual grips and exerts a force to move a bar to which the cable is coupled while the electrical generator or motor is operated to resist the rotation of the axle. These types of devices typically utilize another mechanism for recoiling the cable about the axle and thus pull the bars in the opposite direction. For example, U.S. Pat. No. 4,261,562 discloses a power spring mechanism which recoils the cable onto the axle after the individual has uncoiled a portion of the wire.

These types of devices can still potentially injure the user if during the course of an exercise the exerciser loses a grip of the bar or fatigues. Since these devices exert a resistance to the movement of the bar in both directions, as does the previously discussed weight pulley machines, there still exists the possibility that the bar will snap back and injure the individual.

Still other types of devices are hydraulically powered, with a hydraulic piston reciprocally driving the bar as the exerciser performs various types of exercises. Devices of this type typically require extensive feedback control in order to provide the proper resistance to the exerciser's movement of the lifting mechanism. This feedback control monitors the amount of force applied by the exerciser during the course of moving the lifting mechanism. Examples of hydraulically powered exercising mechanisms are disclosed in U.S. Pat. Nos. 4,235,435 and 4,354,676.

A recent development in exercise devices is the use of a electromagnetic brake as the resistance applying mechanism. A particular benefit in using a magnetic brake is that the resistance can be applied in both directions, whereas electric motors or generators could only provide a resistance in one of the directions, with another mechanism required for applying a reverse resistance.

An example of an exercise device incorporating an electromagnetic brake is disclosed in U.S. Pat. No. 4,518,163. The disclosed device controls the resistance applied by the brake to the motion of a bar in both directions. Resistors, which control the flow of current to the brake, are connected to a series of transducers mounted along an arc following the path of travel for the bar. The transducers are activated sequentially by a wiper conductor mounted to the bar. These resistors vary the amount of current supplied to the electromagnetic brake and thus control the resistance applied by the brake to the bar as it is moved by the individual.

While this device advanced the art of exercising devices by the use of the electromagnetic brake, the device still suffers a disadvantage as a result of the manner by which the resistance is applied to the movement of the bar in both directions. This device varies the resistance applied by the electromagnetic brake in a step-like fashion as the wiper sequentially contacts each transducer and the voltage is abruptly increased by the then contacted resistor. This step-like increase in resistance potentially causes a jerking motion to the movement of the lifting mechanism during the course of an exercise.

There remains a need to provide an exercise device which substantially reduces the potential of injury to an exerciser by minimizing the possibility of the lifting mechanism snapping back upon the exerciser. Further, an exercise device is needed which supplies a gradual control of the resistance, while remaining simplified in construction and operation in order to limit maintenance requirements, particularly since many of these exercise devices are utilized in health club facilities where numerous individuals continuously work the devices.

SUMMARY OF THE INVENTION

The present invention achieves the above objectives by providing an exercise device which gradually applies resistance, in accordance with a predefined resistance gradient, to the movement of a lifting mechanism by an exerciser in at least a first positive resistance direction, while reducing the resistance to substantially zero when the lifting mechanism is moved in a negative resistance direction.

Further, the exercise device of the invention is controlled to reduce the resistance applied in the first direction to substantially zero if the exerciser, due to fatigue, fails to continue moving the lifting mechanism in the first direction for more than a selected time period. This resistance reduction eliminates the potential of the lifting mechanism snapping back upon the exerciser during the course of an exercise routine.

DESCRIPTION OF THE DRAWINGS

The present invention may be better understood and its numerous advantages will become apparent to those skilled in the art by reference to the accompanying figures, wherein like-referenced numerals refer to like elements in the several figures, and wherein:

FIG. 2 is a block diagram showing the interrelationship of the various components of an embodiment of an exercise device of the invention;

FIG. 3 is a schematic illustration of one type of gear box assembly for use with the exercise device of FIG. 1;

FIG. 4 is a graph illustrating one example of a resistance force gradient utilized by the microprocessor of the invention to vary the resistance supplied to a lifting mechanism for a particular exercise device;

DESCRIPTION OF THE INVENTION

The invention is directed to a progressive resistance machine which gradually varies a resistance applied to a lifting mechanism, such as a bar when moved in a first positive resistance direction by an individual for a particular exercise. Once the bar has been moved fully in the first positive resistance direction the device may function to reduce the applied resistance to substantially zero in the opposite negative direction to allow it to be returned by the individual to the start position, or apply a second progressive resistance to the movement of the lifting mechanism in the opposite direction, if such direction is in a second positive resistance direction for another particular exercise.

Figure 1:
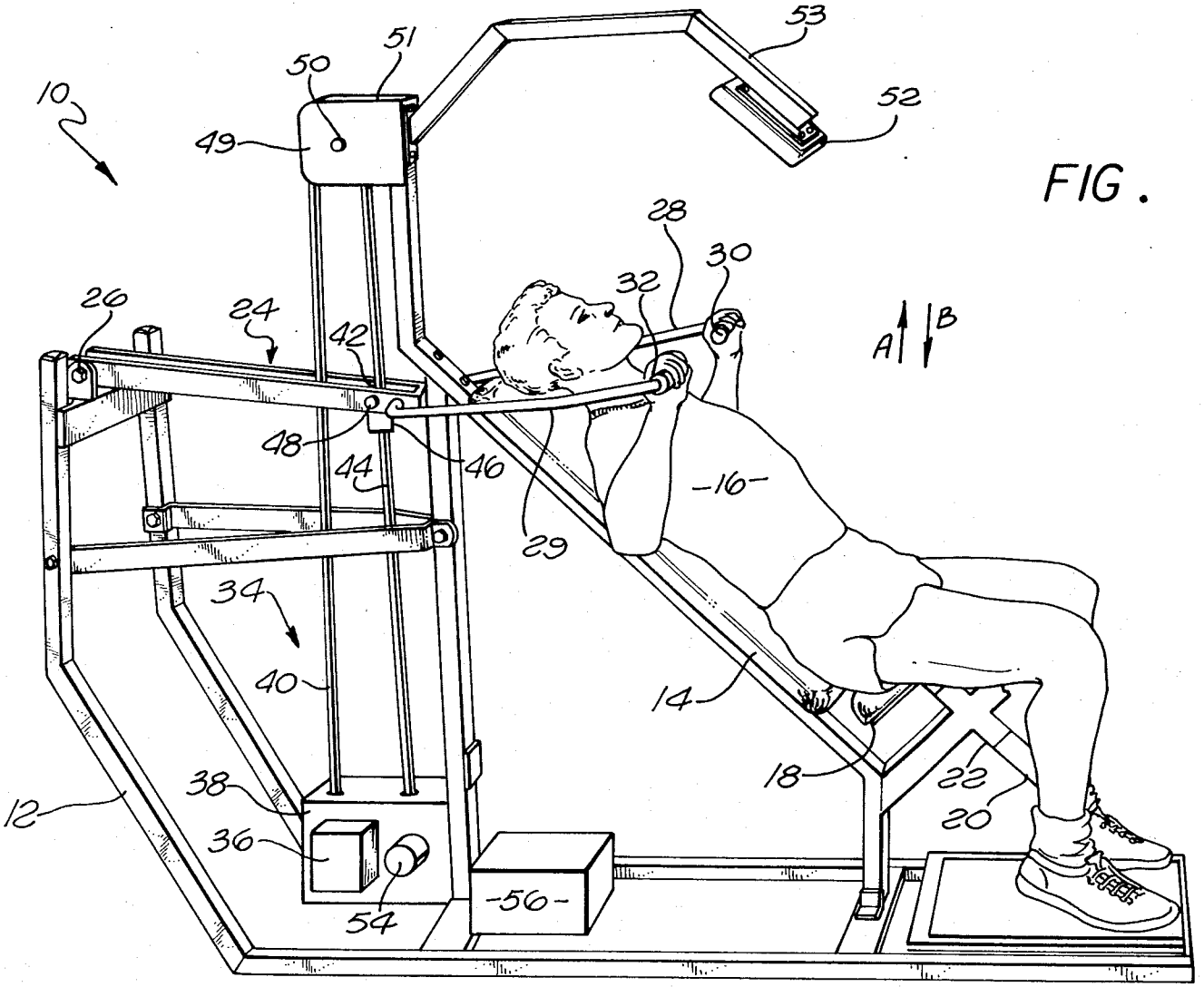
FIG. 1 is a perspective side view of a particular type of exercise device embodying this invention and showing various components of the device.

Referring now to FIG. 1, the exercise machine of the invention will be described in relation to a bench press machine, indicated generally at 10. An exercise machine in accordance with the invention may be any one of numerous types of exerciser machines for exercising different muscles, e.g., latissimus dorsi machines, leg press machines or arm curl machines. The invention resides not in a particular type of exercise machine, but in the manner in which the resistance is applied to the lifting mechanism, which in the illustrated embodiment in FIG. 1 is a bench press bar.

The bench press machine 10 is constructed with a frame 12 to which an individual bench 14 is mounted. The individual 16 who utilizes this bench press 10, lies back against the bench 14 and sits upon a seat 18 to be positioned for exerting an upward force upon a bar 24 in performing the bench press. The seat 18 is movably coupled to the frame 12 by a seat post 20 secured to the seat 18 and which journals and is slidably positioned in a frame sleeve 22. The seat post 20 is held at a desired position in the sleeve 22 by any suitable mechanism which allows the post 20 to fixedly engage the frame sleeve 22 along various points of its length. For example, both the post 20 and frame sleeve 22 can be formed with alignable apertures, not shown, through which a pin, also not shown, can be placed to hold the seat 18 at any desired point along the length of frame sleeve 22. In this manner the bench press machine 10 can be utilized by different sized individuals.

The bench press bar 24 is pivotally mounted on the frame 12. The bar 24 is pivotally coupled by a pivot hinge 26 to the rearward portion of the frame 12. The bar 24 includes two arms 28 and 29 which extend out and over both sides of the bench 14. The two arm ends 30 and 32 function as handles which are gripped by the exerciser 16. The bar 24 is moved away and towards the bench 14 in the direction of arrows A and B by the exerciser 16 during a conventional bench press exercise.

A resistance applying mechanism of the invention, generally indicated at 34, is coupled to the bar 24 in any suitable manner to be able to provide a resistance to the movement of the bar 24, if desired, in both the directions indicated by the arrows A and B.

However, in accordance with the device 10 illustrated, resistance will be applied to movement of the bar 24 by the exerciser 16 in only the direction indicated by the arrow A. The resistance as applied in this direction, which is upwards away from the bench 14, will be referred to herein as a "first positive resistance direction". A resistance which would be applied to the movement of the bar in the opposite direction as indicated by arrow B, that is, the downward direction back towards the platform 14, will be referred to herein as the "negative resistance direction".

Both "positive" and "negative" resistances are well-known terms in the art, and generally relate to a particular type of muscular contraction which occurs as the lifting mechanism is being moved in a given direction. With positive resistance the particular type of muscular contraction known to occur is generally referred to as "concentric contraction". With negative resistance the muscular contraction is termed "eccentric contraction". A device in accordance with the invention will only apply a resistance to the movement of a particular lifting mechanism in that direction which will result in the application of a positive resistance to the movement of that particular lifting mechanism, such as only to the upward movement of the bar 24 of the bench press device 10. It should be noted that this positive resistance direction is not always a movement away from the exerciser's body, but may, for example, be toward the body or even in both directions, such as with an arm curl machine where in one direction the biceps are being worked and in the opposite direction the triceps are being worked. The key is the type of muscular contraction being performed.

By applying only a resistance in a positive direction, the present invention substantially reduces the potential of the lifting mechanism snapping back upon the exerciser 16 when the exerciser 16 becomes fatigued during the course of an exercise.

For the device 10 of FIG. 1, the resistance mechanism 34 applies a resistance to the movement of the bar 24 in the first positive resistance direction and also operates when the bar 24 is being moved in a negative resistance direction to reduce the supplied resistance to substantially zero. The resistance mechanism 34 may also be operated to gradually reduce the supplied resistance to substantially zero when the exerciser 16 for any reason fails to continue moving the bar 24 in the positive resistance direction for a period of time greater than a given threshold limit. This further reduces the potential of the bar 24 from snapping back and injuring the exerciser 16. A preferred time threshold limit is about two seconds. Thus, if the exerciser 16 fails to continue moving the bar 24 in the first positive resistance direction indicated by arrow A for more than about two seconds, the resistance mechanism 34 functions to gradually reduce the supplied resistance opposing the movement of the bar 24 to substantially zero.

The resistance mechanism 34 of the illustrated embodiment includes a brake 36 which is coupled to a torque converting transmission 38 that is linked to the bar 24 by a chain 40. The chain 40, which is coupled to the transmission 38 as will be described in greater detail below, has two ends 42 and 44 attached to the bar 24. The chain end 42 is suitably attached directly to the bar 24, while the chain end 44 is suitably attached to a stirrup 46, which is pivotally mounted to the bar 24 by means of pins, one of which is illustrated at 48. This pivotal connection of the chain end 44 to the bar 24 reduces the wear and tear on the chain 40 as the bar 24 is repetitively moved.

As further illustrated, the chain 40 is positioned about a rotatable, freewheeling sprocket 50, which is rotatably mounted between two plates 49 and 51 attached to the frame 12. Thus, the resistance from the brake 36 is supplied to the bar 24 through the torque converter transmission 38 and chain 40. By positioning the chain 40 about the sprocket 50, the chain ends 40 and 42 are coupled both above and below the bar 24, and are thus located to oppose the movement of the bar 24 in both the upward and downward directions.

The resistance mechanism 34 further includes a microprocessor and display unit 52 which is mounted at the end of a frame arm 53 extending over the exerciser 16. As will be discussed in greater detail, the unit 52 interfaces with the brake 36 and a position encoder 54 to control the amount of resistance being exerted by the brake 36, in response to information provided by the position encoder 54 concerning the relative position of the bar 24.

The brake 36 includes a shaft, seen in FIG. 3 at 58, which is supported for rotation in both the clockwise and counterclockwise direction, and to which, as will be discussed more fully herein, a resistance is applied. As will be discussed hereinafter, the position encoder 54 is a suitable mechanism which can determine the relative position of the bar 24 by directly reading the rotational position of the primary shaft of either the brake 36 or the torque converter (which is a gear box) 38, or for that matter of the bar 24, and develops an output signal corresponding to this positional movement. This output signal is then transmitted to the microprocessor display unit 52 which has been suitably programmed to control the resistance applied to the rotating brake shaft 58. The programming of the unit 52 incrementally controls the resistance applied to the rotating brake shaft 58, as will be discussed more fully herein, in accordance with a predetermined resistance gradient. This resistance gradient is designed to vary the applied resistance proportionally to the actual strength of the muscle group being worked at any given point along the range of motion of the bar 24 away or towards the platform 14.

By directly reading the rotational position of the primary shaft, a more accurate control of the applied resistance is obtained, in comparison to presently available devices which monitor the displacement of the specific lifting mechanism, e.g., the bar 24 or measure the amount of force exerted by the exerciser 16 on the bar 24.

It should be noted that while the resistance mechanism 34 is described in relation to the bench press 10, this resistance mechanism 34 can be utilized in combination with different types of exercise devices by appropriately coupling the resistance mechanism 34 with the lifting mechanism, e.g., bars or pivotally supported arms of any type of lifting exercise machine, such as, but not limited to, machines used to exercise the hamstrings or quadriceps, or those used to exercise the biceps and triceps of the arms.

Referring to both FIGS. 1 and 2, the various components of the resistance mechanism 34 will be described in further detail.

As already stated, the resistance mechanism 34 includes a brake 36, a torque converting transmission 38, a chain 40 which is coupled to the transmission 38 and attached to the bar 24, a position encoder 54 and a microprocessor and display unit 52. The resistance mechanism 34 also includes a power source 56 which is electrically coupled to the microprocessor and display unit 52 and either directly or indirectly to the brake 36 in a manner which allows the unit 52 to regulate the amount of current delivered to the brake 36.

The brake 36 is any suitable mechanism which functions to progressively apply a resistance to a rotatable shaft. Preferably, the brake 36 is an electromagnetic brake, and more preferably an electromagnetic particle brake which applies resistance to a shaft rotating in either the counter and clockwise direction. These types of magnetic brakes are particularly preferred, since the amount of resistance as applied to the rotating shaft can be gradually increased or decreased in either rotational direction. Examples of electromagnetic particle brakes are disclosed in U.S. Pat. Nos. 3,962,595; 4,085,344; 4,130,014; and 4,347,993, which disclosures are incorporated herein by reference.

Typically the amount of resistance supplied by the electromagnetic particle brake is a function of the amount of current supplied either directly or indirectly from the power source 56, as regulated by the microprocessor display unit 52. As the microprocessor display unit 52 varies the supplied current to the brake 36 the amount of applied resistance to the rotation of the shaft 58, in either direction, is increased or decreased. This resistance to the rotational movement is the torque which is transferred to the bar 24 via the torque converting transmission 38 and chain 40. The torque converting transmission 38 is any suitable mechanism which is coupled in some manner to the rotatable shaft 58 such that the resistance to the rotation of the brake shaft 58 is applied as tension to the chain 40 and thus resistance to the movement of the bar 24.

A particular example of a torque converting transmission 38 is illustrated in FIG. 3. Here, the transmission 38 is a typical gear box assembly. The brake shaft 58 has a first toothed gear 60 coaxially mounted thereon, which gear 60 is meshed with a second toothed gear 62 that is coaxially mounted on a shaft 64, which axle 64 is supported for rotation in the torque converting transmission 38. This shaft 64 is the primary shaft of the transmission 38. Also mounted on the secondary axle 64 is a chain drive gear 66, about which the chain 40 is positioned. Thus, in accordance with the illustrated gear box assembly, as the resistance is applied to the rotation of the brake shaft 58, tension is transferred to the chain 40 via the gears 60, 62 and 66 with the resulting resistance applied to the movement of the bar 24.

If desired, the chain drive gear 66 can be directly mounted on the shaft 58 and thus directly apply the induced torque to the bar 24 through the chain 40 without the intervention of the meshed gears 60 and 62. However, in order to provide the necessary tension to the chain 40 when using only the chain drive gear 66 mounted directly on the shaft 58, an exceptionally large electromagnetic particle brake 36 must be utilized. By having the above described gear box arrangement, and further by providing the proper gear ratio between the various gears, a smaller electromagnetic particle brake 36 can be utilized.

As stated, the position encoder 54 determines the relative position of the bar 24 by directly reading the rotational position of the primary axle of either the brake 36 or the torque converting transmission 38 in incremental units sufficient to allow for the gradual increase or decrease of the resistance applied to the movement of the bar 24. As illustrated in FIG. 3, the position encoder 54 is mounted on the primary shaft 64 of the torque transmission 38 and is shown in phantom mounted to the primary shaft 58 of the brake 36. While any suitable type of mechanism which can sense the rotational position of the shaft 64 may be utilized with the present invention, it has been found particularly advantageous to utilize an optical encoder, particularly an optical shaft encoder which is mounted on the shaft 64.

Useful optical shaft encoders are those which are capable of reading or sensing very small incremental degrees of motion of the rotating shaft 64. It has been found that the smaller these incremental units are, the more precise control of the resistance applied by the brake 36 can be obtained. In accordance with a preferred embodiment of the invention, the incremental units of rotational movement read by the position encoder 54, i.e., an optical shaft encoder, should be no greater than about 2 degrees of rotation of the shaft 64. This allows the microprocessor and display unit 52, which communicates and receives information concerning the rotational position of the shaft 64 from the encoder 54, to more precisely control the amount of current supplied to the brake 36, and as such provide a more precise control of the amount of resistance being applied against the movement of the bar 24. An example of a suitable optical shaft encoder is one which can sense at least 180 axisymmetrical positions about the shaft 64, which translates into substantially no greater than 2 degrees of rotation between each position.

As stated, the rotational position of the shaft 64, as read by the position encoder 54, is converted by the encoder 54 to an output signal which is transmitted in a suitable manner to the microprocessor and display unit 52. This microprccessor and display unit 52 compares the position of the rotating shaft 64, by using the encoder 54 output signal, to a resistance force gradient curve to determine the amount of resistance which should be applied to the rotating brake shaft 58 at any given instance.

This resistance gradient is typically calculated to provide an amount of resistance which is related to the amount of force a particular muscle group can apply at each given position of a particular lifting for an exercise. That is, a particular muscle group will have a varying ability to exert a force during the movement of the lifting mechanism in the positive resistance direction during a particular exercise, and the microprocessor and display unit 52 will utilize a specific resistance force gradient to determine the appropriate resistance to be applied for each incremental movement of, for example, the bar 24 of the illustrated bench press device 10, as related by the rotational position of the shaft 64. The position encoder 54 relays the output signal, in response to the position of the shaft 64 and thus of the lifting bar 24, to the microprocessor and display unit 52 which is suitably programmed to compare the position of the shaft 64 to the resistance force gradient and thus regulate the amount of current supplied to the brake 36 for controlling the resistance being applied.

FIG. 4 illustrates a resistance force gradient for a particular type of exercise, e.g., a bench press. The resistance gradient illustrated in FIG. 4 is generally referred to as a force curve. For the purposes of the present invention, this force curve is obtained by measuring the amount of force exerted by numerous individuals at different positions throughout the range of motion for a particular exercise in the first progressive resistance direction and averaging the amounts of force applied by these numerous individuals at each position. These averages are then used to provide a curve based upon the average amount of the maximum force exerted versus the respective position along the range of motion for a particular lifting mechanism, e.g., the bar 24. This force curve is programmed into the microprocessor and display unit 52 to allow for a calculation based on the output signal received from the position encoder 54.

The term "range of motion" as used herein means the complete motion of a particular lifting mechanism in the first positive direction for a particular exercise. The range of motion will differ for different types of exercises and is used in calculating a power curve illustrated in FIG. 4 for a particular exercise.

As already stated, the microprocessor and display unit 52 carries out numerous functions, e.g., regulating the amount of resistance applied in the first positive resistance direction and reducing the resistance to substantially zero when the bar 24 is either being moved in the negative resistance direction or when the exerciser 16 fails to continue moving the bar 24 in the first positive resistance direction for greater than a defined lapse of time. In this regard the unit 52 includes a programmable processor, not shown, which has been programmed to carry out the comparison of the rotational position of the shaft 64, as read by and transmitted to the unit 52 from the encoder 54, with a predetermined resistance force gradient. Once the processor has made this comparison, it causes the electronics, not shown, of the unit 52 to which it is coupled to deliver a desired current to the brake 36. This programming also ensures that the resistance will be reduced to substantially zero when, as a result of the output signal received from the encoder 54, it is sensed that either the bar 24 has stopped being moved or is being moved in the negative resistance direction.

The unit 52 also displays to the particular individual utilizing the device 10 a performance rating for the particular exercise. This performance is based upon a rating using an average of the movement of the bar 24 through the range of motion for the total number of repetitions carried out by the individual versus the ideal range of motion and using an average of the time the individual takes to complete each repetition versus an ideal time for completion is also employed.

This performance rating is based upon the following mathematical expression which is provided by way of a suitably developed program in the processor of the unit 52:

$$\text{Performance Rating} = a \times b \times 10$$

where a=avg. range of motion/ideal range of motion b=reps/time/ideal reps/time

Thus the microprocessor and display unit 52 not only controls of amount of resistance supplied by the brake 36 but also evaluates the performance of a particular exerciser by determining the extent to which that individual has moved the bar 24 through the range of motion, and also by calculating the time this individual takes to move the bar 24 through the range of motion.

The processor of the unit 52 may be of any conventional design, and may or may not be reprogrammable. In this regard, the processor of the unit 52 can be a Programmable Read Only Memory chip (PROM) which has been suitably programmed to provide the desired functions.

Figure 5:
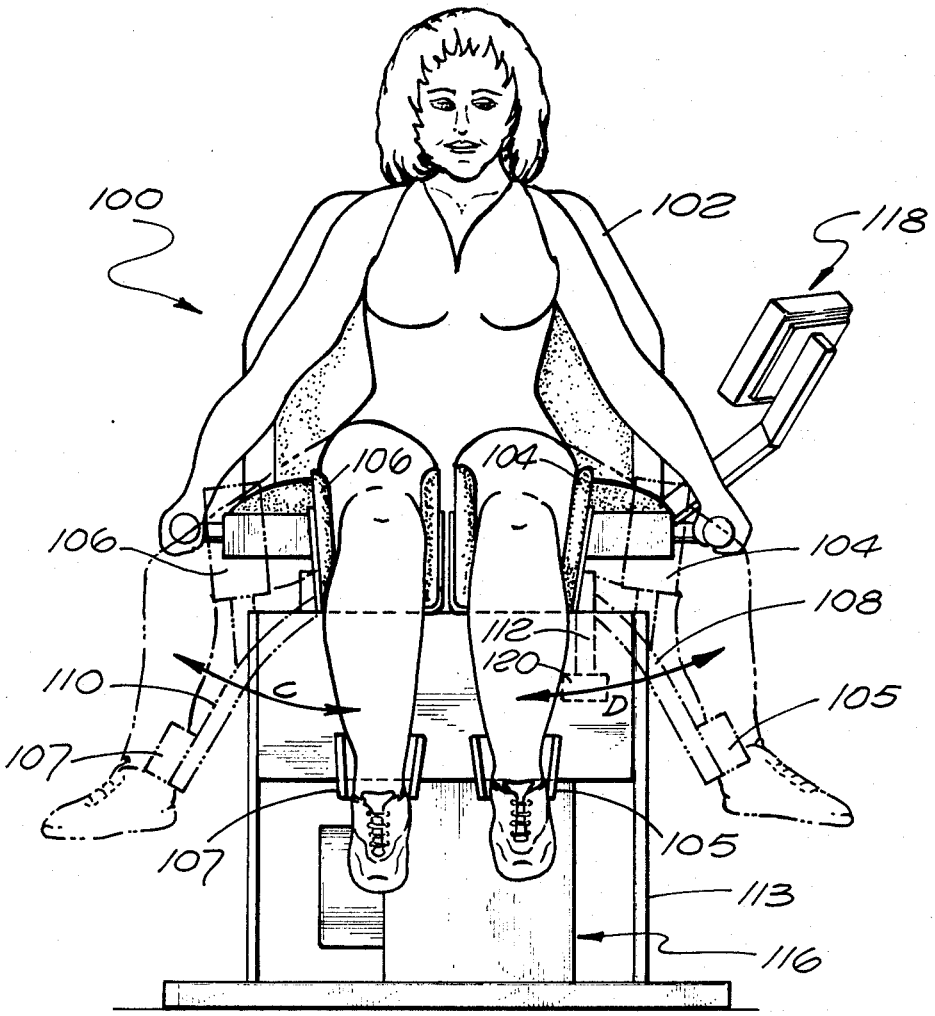
FIG. 5 is a front perspective view of another type of exercise device embodying the invention.

Referring to FIG. 5, another exercise device embodying the invention is generally seen at 100. This particular exercise device 100 is an inner/outer thigh exercising machine where the individual positions herself upon a seat and back rest 102 which is mounted to a frame support 113. The exerciser places each leg into the respective leg grips 104 and 105, and 106 and 107 secured to the arms 108 and 110, such arms 108 and 110 being shown in phantom. These arms 108 and 110 ar.e mounted for pivotal movement to the device 100. Each arm 108 and 110 is respectively secured at one end to a rotatable shaft, with only shaft 112 being shown in phantom. These shafts are ccupled to a resistance mechanism 116, which mechanism 116 includes an electromagnetic brake, gear box assembly and optical shaft encoder, all of which are not illustrated but are substantially equivalent to those discussed above. The gear box assembly of the particular device 100 is of the type which will apply an equivalent resistance to the rotation of either shaft connected to arms 108 and 110.

In accordance with the exercise device 100, the individual exerciser will move the arms 108 and 110 outward as shown by the arrows C and D to exercise the outer thigh muscles and move the arms 108 and 110 inward to exercise the inner thigh muscles. The movement of the arms 108 and 110 in either of these directions is the respective positive resistance direction depending upon which groups of muscles, the inner or outer thigh muscles, the exerciser wishes to work.

It is this aspect of this embodiment, that is, the application of resistance in two opposing positive resistance directions, which differs from the previously discussed embodiment. That is, the exercise device 100 is capable of working two opposing muscle groups by applying a resistance to the movement of the lifting mechanism in either of the two directions. The device 100 includes a microprocessor and display unit, as seen at 118, which is programmed to apply a progressive resistance to the movement of the arms 108 and 110, in either direction. This resistance can be applied both as the particular arm 108 or 110 is first moved outward, and then moved inward, or applied only in one of the directions to which the arm's 108 or 110 are being moved. Thus the microprocessor and display unit 118 is programmed to apply a positive resistance to the movement of the arms 108 and 110 in either of two positive resistance directions, either concurrently or subsequently.

Another example of an exercise device emboding this aspect of the invention is an arm curl device which exercises both the biceps and the triceps, either concurrently c,r subsequently.

It should further be noted that an encoder 120 of the device 100, which is illustrated schematically in phantom, is shown mounted to read the rotational position of the shaft 112 to which the arm 108 is mounted. Thus the optical encoder has been described and illustrated as mounted to read the rotational position of any one of the primary shafts of the exercise device, that is, the primary shaft of either the electromagnetic brake, the torque converter (the main shaft of a gear box) or the lifting mechanism (the shaft about which the mechanism rotates).

Figure 6:
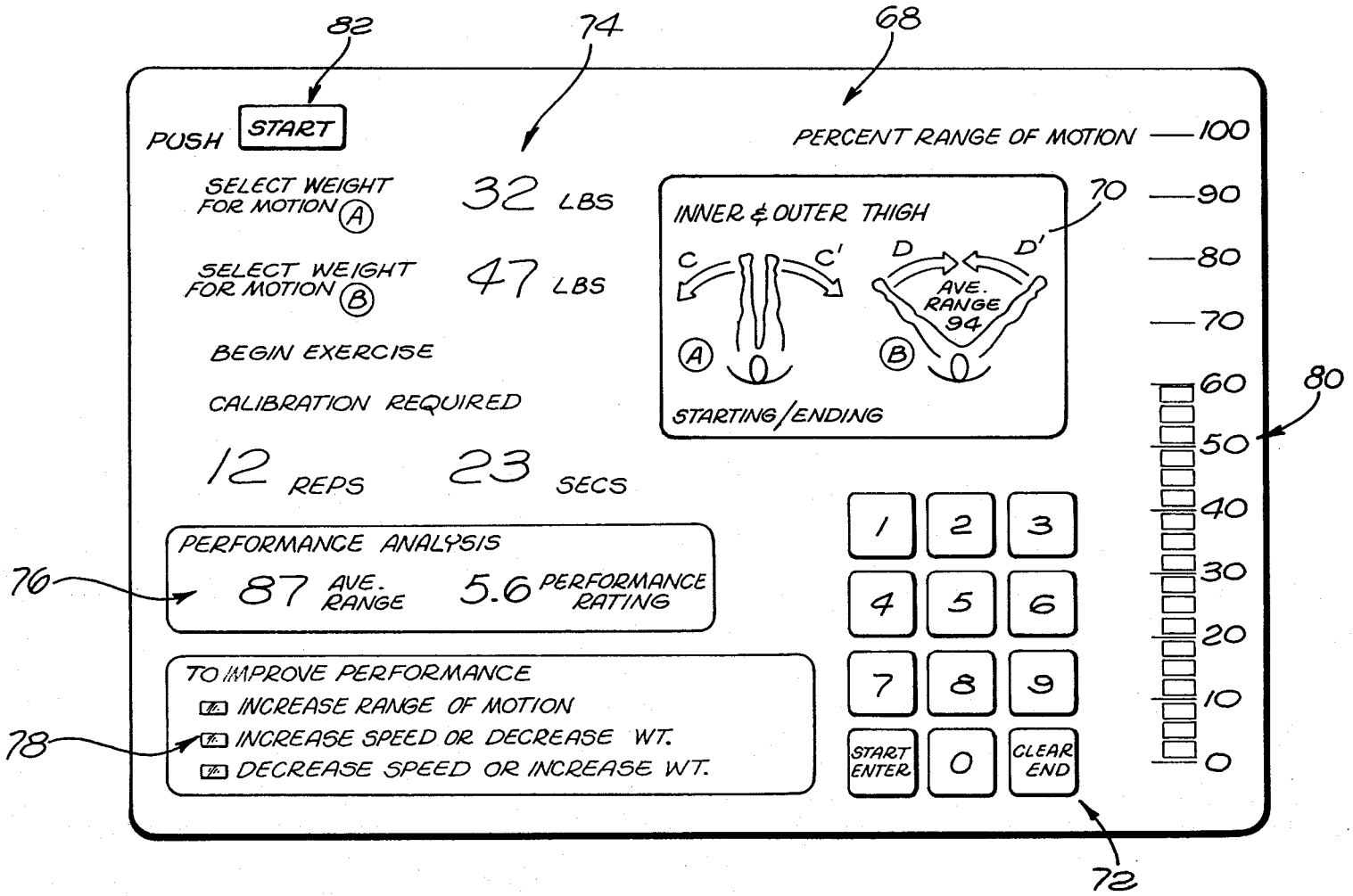
FIG. 6 is a view of the face of a display module for the device of FIG. 5.

Referring now to FIG. 6, an example of a display/input device for the microprocessor and display unit 118 for the device of FIG. 5 is illustrated generally at 68. The display/input device 68 allows the individual exerciser to enter in the maximum amount of weight, which is equivalent to the amount of resistance desired to be applied by the resistance mechanism 116, for a selected exercise of the device 100. The exercise device as schematically illustrated on the display/input device 68 is of the device 100 discussed above for exercising the two different portions of the thigh muscle group. As stated, the inner/outer thigh muscle group may be exercised concurrently or subsequently. As seen, the display/input device 68 includes an exercise illustration portion 70 wherein the user's legs in the illustration labeled A move the two pivotal arms 108 and 110 apart to exercise the outer thigh muscles. The schematic leg illustration labeled B shows exercising the inner thigh muscle group by moving the arms 108 and 110 inward. The display/input device 68 also indicates the maximum weight selection for each of the motions labeled A and B at the two locations indicated generally at 74. Thus the illustrated display/input device 68 allows an individual to either first work the inner thigh muscles and then subsequently the outer thigh muscles, or to work both groups concurrently.

The entering of the particular maximum weight or resistance equivalents is done through the keyboard 72 and displayed at that portion 74 of the display/input 68. If the exerciser desires to work both the inner and outer thigh, a maximum weight is selected for each positive resistance direction. The display/input device 68 further shows both the average for the range of motion for the total repetitions and the overall performance for the particular exercise at location 76, and a performance improvement instruction area as indicated at location 78. Finally, a bar graph 80 indicates the range of motion for each repetition.

Referring to FIG. 6, the mode of operation of a device 10 in accordance with the embodiment described in relation to the leg exerciser machine 100 will be discussed.

The first step in operating the exercise device of the invention is to activate the device and thus supply pcwer to the microprocessor and keyboard unit 11B, which is done by pushing the start button 82 on display/input 68.

After the device is activated, step two invclves the individual exerciser entering via the keyboard 72 the maximum desired weight for either one of the particular exercises "A" or "B", or both, which weight is equivalent to the amount of resistance which will be applied to movement of the particular arms 108 and 110 of the device 100.

The third step involves the actual moving of the arms 108 and 110 through the particular range of motion by the exerciser. The amount of resistance applied as the arms 108 and 110 are moved in the first or second positive resistance direction will vary in accordance with two different force gradients, one such gradient for the inner thigh exercise movement and one for the outer thigh movement, as programmed into the processor of the microprocessor and display unit 118. The exerciser's movement through the range of movement for each repetition is shown by bar graph 80.

When only one of the exercises "A" or "B" is chosen and the exerciser either fails to continue to move the arms 108 and 110 in the chosen positive resistance direction for greater than a pre-defined lapse of time, i.e., two seconds, or begins to move the arms 108 and 110 in the opposite negative resistance direction, the unit 110 functions to reduce the applied resistance to substantially zero.

The fourth step requires the exerciser to repeat the particular exercise by moving the arms 108 and 110 through the range of motion in the given directions.

The fifth step involves the averaging of the total repetitious movements of the arms 108 and 110 by the exerciser through the range of motion by a suitable provided programming of the unit 118 to allow for a determination of a performance rating, which is displayed to the exerciser at location 76.

Finally in step 6, the individual may reactivate this particular machine and carry out steps 1-5 again or move on to another exercise machine and repeat similar procedures on that machine.

While the preferred embodiments have been described and illustrated herein, various modifications and substitutions may be made thereto without departing from the scope and spirit of the invention. Accordingly, it is to be understood that the present invention has been described by way of illustration not limitation.

What is claimed is:

1. An exercising device comprising:

lifting means supported to allow an exerciser to engage a portion thereof to carry out one or more selected exercises, said lifting mechanism adapted for movement in at least two opposing directions;

load regulating means being coupled to said lifting means and selectively operable to vary a resistance applied against the movement of said lifting means as said lifting means is being moved in either or both of said directions;

control means adapted to selectively operate said load regulating means to control said amount of resistance applied agains the movement of said lifting means, said control means defining a range of motion and a force curve for each of said exercises, which force curve delineates said amount of varied resistance to be applied against said movement of said lifting means independent of any force being exerted by or against said lifting means and for incremental degrees in movement of said lifting means, said control means operating said load regulating means in relation to said incremental movement of said lifting means to effect the application of said applied resistance by said load regulating means as said lifting means is being moved during each of said exercises in a positive resistance direction for said selected exercise, said control means further selectively operating said load regulating means to reduce said applied resistance to substantially zero when said lifting means is moved in a negative resistance direction for one of said exercises, provided that said direction is not a positive resistance direction for another of said exercises; and display means electrically coupled to said control means which includes one or more portions for visually displaying various conditions to said exerciser during said selected exercise, and which includes one or more input portions to allow said exerciser to operate said device, with one of said input portions being adapted to receive an indicated maximum resistance from said exerciser, which maximum resistance is correlated by said control means to a position on said force curve which delineates a maximum amount of said resistance to be applied to said lifting means.

2. The device of claim 1 wherein said load regulating means comprises:

brake means which includes one or more rotatable shafts to which a resistance is applied by the operation of said brake means, one of said shafts being coupled to said lifting means for transferring said applied resistance, to said lifting means as said lifting means is being moved during said exercise;

sensing means coupled to one of said shafts of said brake means, which sensing means is adapted to sense in incremental units said shaft position as it rotates, said sensing means generating a signals indicative of each said sensed incremental units which is relayed to said control means.

3. The device of claim 2 wherein said control means includes suitable electronic circuitry coupled to said sensing means for receiving said generated signals indicative of said incremental units, said control means functioning to determine from said received signals said amount of resistance to be applied against the movement of said lifting means in accordance with said defined range of motion and said force curve.

4. The device of claim 3 wherein each of said opposing directions is a positive resistance direction of said lifting means.

5. The device of claim 4 wherein said control means is operable for either concurrently applying a different varying resistance to the movement of said lifting means in both of said positive resistance directions, or applying said varying resistance independently in a selected one of said positive resistance directions and for controlling said brake means to substantially reduce said resistance applied to said rotating brake shaft to zero when said exercise fails to continue to move said lifting means in said selected positive resistance direction.

6. The device of claim 5 wherein said brake means mechanically resists said shaft rotation.

7. The device of claim 5 wherein said brake means is an electromagnetic particle brake.

8. The device of claim 7 wherein said control means controls said brake means by varying a current applied thereto.

9. The device of claim 8 wherein said control means includes an input means adapted for allowing said exerciser to select said maximum resistance.

10. The device of claim 5 wherein said sensing means sensed incremental units are each equal to or less than about 2 degrees of rotational movement of said primary shaft.

11. The device of claim 10 wherein said control means regulates said brake means to reduce said applied resistance to substantially zero when said exerciser fails to contine to move said lifting means in either of said positive resistance directions for longer than a defined period of time until said lifting mechanism is moved in said other positive resistance direction.

12. The device of claim 11 wqherein said defined period of time is less than or equal to about two seconds.

13. The device of claim 11 wherein said display means includes at least a first portion for visually displaying an indication of a degree said exerciser has moved said lifting meeans through said range of motion in said positive resistance direction to said exerciser during said movement of said lifting means.

14. The device of claim 13 wherein said display means further includes a second portion for indicating a rating of said exerciser's performance of said exercise as based upon an average of that extent said exercise moved said lifting means through said range of motion and that number of times said exerciser repeated said movement of said lifting means through said range of motion within a given period of time.

15. An exercising device comprising:

lifting means supported to allow an exerciser to engage a portion thereof to carry out a selected exercise, said lifting mechanism adapted for movement in at least two opposing directions;

brake means which includes one or more rotatably shafts, said brake means being selectively operable to apply a resistance to the rotation of one of said shafts, with said shaft being further coupled to the remainder of said shafts to transfer said applied resistance, one of said brake means shafts being coupled to said lifting means to transfer said applied resistance to said lifting means as said lifting mean sis being moved during said exercise;

sensing means coupled to one of said rotatably shafts of said brake means which is adapted to sense in incremental degrees said rotational position of said shaft, and which sensing means generates a signal indicative of said sensed rotational position of said shaft;

control means electrically coupled to said sensing means and said brake means, said control means selectively operating said brake means to control said amount of resistance applied against the movement of said lifting means, said control means defines a range of motion and a force curve for each of said exercises, which force curve delineates said amount of varied resistance to be applied against said movement of said lifting means independent of any force being exerted by or against said lifting means, and for incremental degrees in movement of said lifting means, said control means operating said brake means in relation to said incremental movement of said lifting means to effect the application of said applied resistance by said brake means in accordance with said force curve as said lifting means is being moved during each of said exercises in a positive resistance direction for said selected exercise, said control means further selectively operating said brake means to reduce said applied resistance to substantially zero when said lifting means is moved in a negative resistance direction for one of said exercises, provided that said direction is not a positive resistance direction for another of said exercises and further operating said brake means when said exerciser fails to continue to move said lifting means in said positive resistance direction within a prescribed period of time; and display means electrically coupled to said control means which includes at least a first portion for visually displaying an indication of a degree said exerciser has moved said lifting means through said range of motion in said positive resistance direction to said exerciser during said movement of said lifting means, a second portion for indicating a rating of said exerciser's performance of said exercise as based upon an average of that extent said exerciser moved said lifting means through said range of motion and that number of times said exerciser repeated said movement of said lifting means through said range of motion within a given period of time, and a third portion which is adapted to receive an indicated maximum resistance from said exerciser, which maximum resistance is correlated by said control means to a position on said force curve which delineates a maximum amount of said resistance to be applied to said lifting means.

16. The device of claim 15 wherein said control means includes suitable electronic circuitry coupled to said sensing means for receiving said generated signals indicative of said incremental units, said control means functioning to determine from said received signals said amount of resistance to be applied against the movement of said lifting means in accordance with said defined range of motion and said force curve.

17. An exerciising device comprising:

lifting means supported to allow an exerciser to engage a portion thereof to carry out one or more selected exercises, said lifting mechanism adapted for movement in at least two opposing directions;

brake means which includes one or more rotatable shafts, said brake means being selectively operable to apply a resistance to the rotation of one of said shafts, with said shaft being further coupled to the remainder of said shafts to transfer said applied resistance, one of said brake means shafts being coupled to said lifting means to transfer said applied resistance to said lifting means as said lifting means is being moved during said exercise;

sensing means coupled to one of said rotatable shafts of said brake means which is adapted to sense in incremental degrees said rotational position of said shaft, and which sensing means generates a signal indicative of said sensed rotational position of said shaft; and control means electrically coupled to said sensing means and said brake means, said control means selectively operating said brake means to control said amount of resistance applied against the movement of said lifting means, said control means defines a range of motion and a force curve for each of said exercises, said range of motion and said force curve delineate said amount of varied resistance to be applied against said movement of said lifting means independent of any force being exerted by or against said lifting means and for incremental degrees in movement of said lifting means, said control means operating said brake means in relation to the movement of said lifting means to effect the application of said applied resistance by said brake means as said lifting means is being moved during each of said exercises in a positive resistance direction for said selected exercise, said control means further selectively operating said brake means to reduce said applied resistance to substantially zero when said lifting means is moved in a negative resistance direction for one of said exercises, provided that said direction is not a positive resistance direction for another of said exercises and further operating said brake means when said exerciser fails to continue to move said lifting means in said positive resistance direction within a prescribed period of time.

* * * * *

UNITED STATES PATENT AND TRADEMARK OFFICE

CERTIFICATE OF CORRECTION

PATENT NO. : 4,765,613

DATED : August 23, 1988

INVENTOR(S) : Harv Voris

It is certified that error appears in the above-identified patent and that said Letters Patent is hereby corrected as shown below:

Column 8, line 3, delete "microprccessor" and insert --microprocessor--

Column 9, line 45, delete "ar.e" and insert --are--

Column 9, line 49, delete "ccupled" and insert --coupled--

Column 10, line 17, delete "emboding" and insert --embodying--

Column 10, line 19, delete "c,r" and insert --or--

Column 11, line 9, delete "pcwer" and insert --power--

Column 11, line 12, delete "invclves" and insert --involves--

Column 12 , line 3, delete "agains" and isnert --against--

Column 13, line 25, delete "wqherein" and insert --wherein--

Column 13, line 30, delete "meeans" and insert --means--

Column 13, line 46, delete "rotatably" and insert --rotatable--

Column 13, line 54, delete "sis and insert --is--

Column 13, line 55, delete "rotatably" and insert --rotatable--

Column 14, line 49, delete "exerciising" and insert --exercising--

Column 11, line 9 delete "11B" and insert --118--

Signed and Sealed this

Fourteenth Day of February, 1989

*Attest:*

DONALD J. QUIGG

*Attesting Officer*

*Commissioner of Patents and Trademarks*